US005872350A

United States Patent [19]

Moser

[11] Patent Number: 5,872,350

[45] Date of Patent: Feb. 16, 1999

[54] PAPER FIRE PREVENTER

[75] Inventor: Rabin Moser, Victor, N.Y.

[73] Assignee: Xerox Corporation, Stamford, Conn.

[21] Appl. No.: 976,274

[22] Filed: Nov. 21, 1997

[51] Int. Cl.[6] ..... G03G 15/20

[52] U.S. Cl. ..... 219/216; 399/69; 399/331

[58] Field of Search ..... 219/216, 469–471; 399/68, 329–334; 432/60, 228; 492/46; 118/60

[56] References Cited

U.S. PATENT DOCUMENTS

| | | | |
|---|---|---|---|
| 3,898,424 | 8/1975 | Thettu | 219/216 |
| 4,021,641 | 5/1977 | Elter | 219/216 |
| 4,114,021 | 9/1978 | Nishide et al. | 219/216 |
| 4,197,445 | 4/1980 | Moser | 219/216 |
| 4,567,349 | 1/1986 | Henry et al. | 219/216 |
| 5,268,559 | 12/1993 | Jacobs | 219/216 |
| 5,392,701 | 2/1995 | Schiel | 219/469 |
| 5,571,066 | 11/1996 | Katser | 492/46 |
| 5,636,349 | 6/1997 | Landa et al. | 399/307 |
| 5,666,627 | 9/1997 | Yamaguchi | 399/330 |

FOREIGN PATENT DOCUMENTS 55-134880 10/1980 Japan .

*Primary Examiner*—Teresa Walberg
*Assistant Examiner*—J. Pelham
*Attorney, Agent, or Firm*—Benjamin B. Sklar; Robert A. Chittum

[57] ABSTRACT

A Nip Forming Fuser Roll (NFFR) fuser. The fuser is constructed to be self-stripping, that is, the roll contacted by the substrate carrying the toner images is fabricated from a relatively thick elastomeric material which under pressure exerted through contact of the nip forming members is sufficiently strained as the substrate passes in and out of the nip that the fuser roll is self-stripping. An external source of energy in addition to an internal source is used for elevating the surface temperature of the fuser roll member contacted by the toner image carrying substrate. A shield is provided for precluding contact of the external heat source by the substrate in the event of a misstrip. The shield which is fabricated from an infrared radiation transmissive polymer material is supported in intimate contact with the heated fuser member to minimize the presence of oxygen for minimizing the possibility of substrate combustion.

10 Claims, 2 Drawing Sheets

PAPER FIRE PREVENTER

BACKGROUND OF THE INVENTION

This invention relates generally to a heat and pressure fuser for an electrophotographic printing machine, and more particularly the invention is directed to a Nip Forming Fuser Roll (NFFR) structure including an external heat source and shield for preventing misstripped substrates from contacting the external heat source.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser (NFFR), the heated fuser roll is provided with a layer or layers that are deformable by a harder pressure roll when the two rolls are pressure engaged. The length of the nip determines the dwell time or time that the toner particles remain in contact with the surface of the heated roll.

The heated fuser roll is usually the roll that contacts the toner images on a substrate such as plain paper. In any event, the roll contacting the toner images is fabricated with a relatively thick, readily deformable, elastomeric layer of layers for providing a roll structure that is self-stripping.

With the requirement for increased productivity or the ever increasing speeds at which consumers want their copies produced, come the ever increasing problems associated with fusing such images at the higher speeds. One type of fuser that allows for higher speeds utilizes an external thermal energy source which cooperates with an internal energy source for effecting high throughput speed. While the heated fuser roll of such a fuser is fabricated such that it is self-stripping misstrips occasionally occur. When a misstrip does occur it is necessary to prevent contact of the external heat source by the substrate carrying the toner images.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,268,559 granted to Robert M. Jacobs on Dec. 7, 1993 discloses a belt fuser which is self-stripping. The belt and a pressure roll form a nip through substrates carrying toner images pass with the toner images contacting the belt. The belt is entrained about a plurality of rollers for movement in an endless path. One of the rollers which is a drive roller for effecting belt movement is overdriven for causing a post-nip extent of the belt to stretch for effecting separation of the substrates from the belt.

U.S. Pat. No. 4,114,021 granted to Nishide et al on Sep. 12, 1978 discloses a heated roll fixing device for electrophotographic copying machines, wherein a first roll is coated on the surface with a heat-resistant releasing agent and is adapted to contact toner images on a supporting body. A second roll cooperates with the first roll for pressure and heat fixing the toner images to the supporting body. The fixing device is characterized, in that, either the first or second roll but at least the first roll is provided with an inner heating means and an outer heating means, the latter heating means having a small heat capacity which is constructed in a manner to surround the first roll.

U.S. Pat. No. 4,021,641 granted to John F. Elter on May 3, 1977 relates to an apparatus for heat fixing toner images electrostatically adhered to copy paper. The apparatus is characterized by the provision of a radiant energy source together with a parabolic reflector and lens structure for focusing the energy onto the toner images. The lens structure in the preferred embodiment comprises a Fresnel lens which is fabricated in the form of a belt entrained about the reflector and energy source which belt is adapted to be moved relative to the reflector and the heat source.

U.S. Pat. No. 3,898,424 granted to Raghulinga R. Thettu on Aug. 5, 1975 relates to an apparatus for heat fixing toner images electrostatically adhered to copy paper. The apparatus is characterized by the provision of plural radiant energy sources capable of fusing low density as well as high density images in an efficient manner. In order to prevent physical contact of the radiant energy sources by the copy paper, a shield is provided which is transparent to energy in the wave length bands required for fusing high and low density images.

BRIEF SUMMARY OF THE INVENTION

According to the intents and purposes of the present invention, there is provided a heat and pressure fuser roll fuser structure comprising an internally heated fuser roll for elevating the surface thereof to operating temperatures. An external source of thermal energy is also provided which is positioned adjacent the surface of the heated fuser member. The heated fuser roll is provided with an elastomeric layer which is deformable such that the fuser roll is self-stripping. A shield disposed intermediate the external energy source and the heated fuser roll member prevents a misstripped substrate carrying toner images from contacting the external heat source.

The shield which is fabricated from an infrared radiation transmissive polymer material is supported in intimate contact with the heated fuser member to minimize the presence of oxygen for minimizing the possibility of substrate combustion caused by the external heat source. The shield comprises an elongated member which is supported, one end by a supply reel and the other end by a take-up reel.

DESCRIPTION OF THE PREFERRED EMBODIMENT(S) OF THE INVENTION

Figure 1:
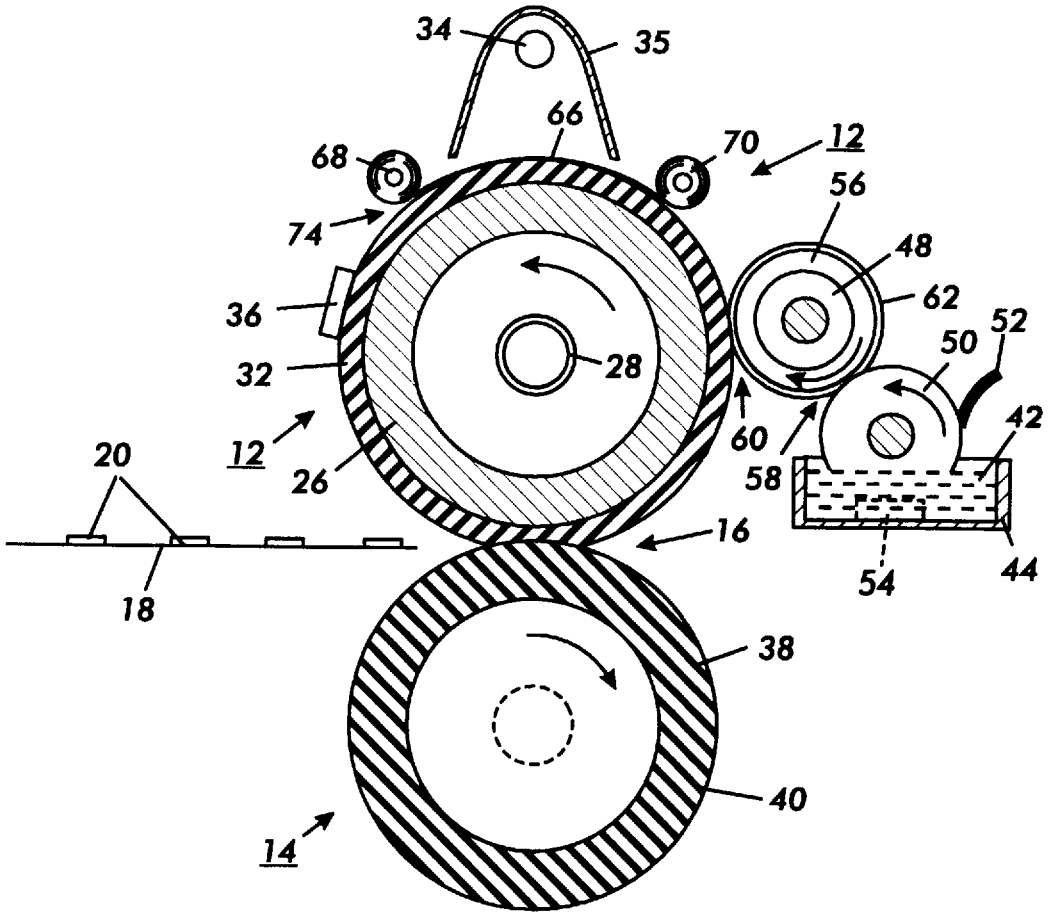
FIG. 1 is a schematic representation of a heat and pressure fuser incorporating the invention.
Figure 2:
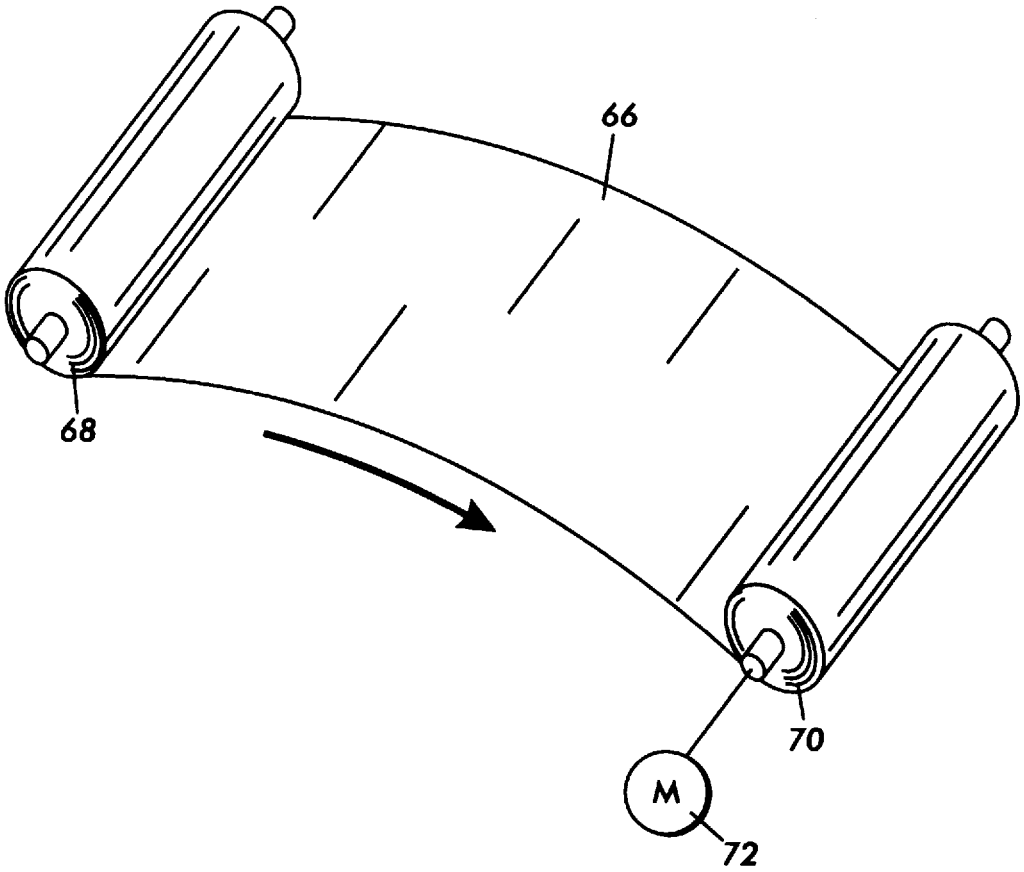
FIG. 2 is a is schematic representation of a shield utilized with the heat and pressure fuser of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

FIG. 1 discloses a Nip Forming Fuser Roll (NFFR) fuser structure generally indicated by reference character 10. The fuser structure comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the heated fuser roll structure by the non-heated pressure roll structure to thereby form the nip 16.

As the substrate passes out of the nip, the substrates generally are self-stripping except for very light weight ones. These substrates require a guide (not shown) to lead them away from the fuser roll structure. After separating from the fuser roll, substrates are free to move along a predetermined path toward the exit of the machine (not shown) in which the fuser apparatus 10 is to be utilized.

The heated roll structure 12 comprises a rigid core or hollow cylinder 26 having a radiant quartz heater 28 disposed in the interior thereof. The heated fuser roll structure further comprises a relatively thick (in the order of 0.003 to 0.020 inch) deformable elastomeric layer 32. The layer 32 is fabricated from silicone rubber or the like. When suitably energized via circuitry (not shown), the heating element 28 radiates heat to the cylinder 26 which is then conducted to the outer surface of the layer 32.

An external source of thermal energy such as a lamp 34 together with a reflector 35 are supported adjacent the heated fuser roll. The external energy source 34 together with the internal heat source 28 serve to elevate the surface temperature of the layer 32 to its fusing temperature.

A contact temperature sensor 36 is provided for sensing the surface temperature of the roll structure 12. The temperature sensor, in conjunction with conventional circuitry (not shown), maintains the heat sources 28 and 34 at predetermined outputs to thereby cause the surface temperature of the layer 32 to be elevated and maintained at a predetermined value, for example, in the order of 350°–400° F.

The backup roll structure 14 comprises a metal core 38 to which is adhered a relatively thin layer 40 of a suitable adhesive material. The layer 34 may be provided with a sleeve of suitable material (not shown) Due to the relative constructions of the fuser roll structure 12 and pressure roll structure 14, the fuser roll is deformed by the harder pressure roll structure when the required pressure is applied therebetween, the pressure being a function of the desired deformation which corresponds to the desired length of the nip 16.

While the deformable layer 32 is abhesive, it has been found desirable to coat this layer with a release agent material 42 contained in a sump 44. The material 42 comprises a polymeric release agent material such as a relatively low viscosity silicone oil.

For the purpose of coating the heated roll structure 12 there is provided a Release Agent Management (RAM) system generally indicated by reference character 46. The mechanism 46 comprises a donor roll 48, metering roll 50, doctor blade 52 and a wick 54. The metering roll 50 is partially immersed in the release agent material 42 and is supported for rotation such that it is contacted by the donor roll 48 which, in turn, is supported so as to be contacted by the heated roll structure 12. As can be seen, the orientation of the rolls 48 and 50 is such as to provide a path for conveying material 42 from the sump to the surface of the heated roll structure 12. The metering roll is preferably a nickel or chrome plated steel roll having a 4-32 AA finish. The metering roll has an outside diameter of 1.0 inch. As mentioned above, the metering roll is supported for rotation, such rotation being derived by means of the positively driven heated roll structure 12 via the rotatably supported donor roll 48. In order to permit rotation of (at a practical input torque to the heated roll structure 12) the metering roll 50 in this manner the donor roll 48 comprises a deformable layer 56 which forms a first nip 58 between the metering roll and the donor roll and a second nip 60 between the latter and the heated roll. The nips 58 and 60 also permit satisfactory release agent transfer between the rolls and roll structure. Suitable nip lengths are about 0.10 inch.

Wick 54 is fully immersed in the release agent and contacts the surface of the metering roll 50. The purpose of the wick is to provide an air seal which disturbs the air layer formed at the surface of the roll 50 during rotation thereof. If it were not for the function of the wick, the air layer would be coextensive with the surface of the roll immersed in the release agent thereby precluding contact between the metering roll and the release agent.

The wiper blade 52 preferably fabricated from Viton is ¾×⅛in cross section and has a length coextensive with the metering roll. The edge of the blade contacting the metering roll has a radius of 0.001–0.010 inch. The blade functions to meter the release agent picked up by the roll 50 to a predetermined thickness, such thickness being of such a magnitude as to result in several microliters of release agent consumption per copy. The donor roll 48 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 56 of the donor roll preferably comprises overcoated silicone rubber. However, other materials may also be employed.

A thin sleeve 62 on the order of several mils, constitutes the outermost surface of the roll 48, the sleeve material comprises Teflon, Viton or any other material that will impede penetration of silicone oil into the silicone rubber. While the donor rolls may be employed without the sleeve 62, it has been found that when the sleeve is utilized, the integritiy of the donor roll is retained over a longer period and contaminants such as lint on the heated roll 12 will not readily transfer to the metering roll 50. Accordingly, the material in the sump will not become contaminated by such contaminants.

While the heated fuser roll structure 12 is constructed such that it is self-stripping it will be appreciated that from time to time substrate misstripping will occur. In the absence of the present invention, a misstripped substrate would be carried on the surface of the heated fuser roll 12 and be moved past the heat lamp 34. In prior art roll fusing devices of the type contemplated, the substrate which is usually plain paper can catch fire if contacts the lamp 34 or is exposed to it the heat for the lamp long enough.

In accordance with the present invention, a shield 66 is provided which is supported in intimate contact with the heated fuser roll structure 12. The shield is supported intermediate the fuser roll structure and the lamp 34. The shield comprises and elongated member which has its ends secured by a supply roll or reel 68 and a take-up roll or reel 70. The rolls 68 and 70 support the elongated shield such that intimate contact between it and the heated fuser roll structure is assured. The shield which has a thickness in the order of 0.005 to 0.006 inch is preferably fabricated from an infrared, radiation transmissive polymer material such as PFA a PerFluoroAlkoxy resin. The shield may also be fabricated from an infrared radiation absorptive material so long as it is held in intimate contact with the heated fuser roll. The take-up reel 70 is drivingly connected to a motor 72 such that the elongated shield can be advanced as needed.

Pursuant to the invention, when a misstrip occurs a substrate 18 will be carried through a nip 74 formed between the shield and the heated fuser roll. Thus, the shield prevents contact between the lamp 34 and the substrate. Moreover, due to the intimate contact between the shield and the heated fuser roll, there is relatively little oxygen available for supporting combustion of a paper substrate should the substrate be stalled in this nip for any length of time.

I claim:

1. A heat and pressure fuser, said fuser comprising:

a pair of nip forming fuser members;

an external source of thermal energy for elevating the surface temperature of one of said nip forming fuser members; and a shield which is transparent to infrared radiation, the shield being in contact with said one of said nip forming fuser members and interposed between said one of said nip forming fuser members and said external source of thermal energy for preventing contact of said external source of thermal energy by a substrate passing through said nip that fails to strip from said one of said nip forming fuser members.

2. A heat and pressure fuser according to claim 1 wherein said shield comprises an elongated member and supports therefor.

3. A heat and pressure fuser according to claim 2 including supply and take-up reels for said elongated shield member.

4. A heat and pressure fuser according to claim 3 wherein said elongated member is fabricated from perfluoroalkoxy resin.

5. A heat and pressure fuser, said fuser comprising:

a pair of nip forming fuser members;

an external source of thermal energy for elevating the surface temperature of one of said nip forming members;

an elongated shield member which absorbs infrared radiation and supports therefor, the shield member being in contact with said one of said nip forming members and interposed between said one of said nip forming members and said external source of thermal energy for preventing contact of said external source of thermal energy by a substrate passing through said nip that fails to strip from said one of said nip forming members; and supply and take-up reels for said elongated shield member.

6. A heat and pressure fuser according to claim 5 wherein said elongated member is fabricated from perfluoroalkoxy resin.

7. In a method of fusing toner images to a substrate by passing the substrate through a nip formed between an internally heated fuser roll and a pressure roll, the steps of:

exposing said internally heated fuser roll to an external source of heat; and supporting a shield which is transparent to infrared radiation in contact with said fuser roll and between said internally heated fuser roll and said external source of heat.

8. The method according to claim 7 wherein said shield comprises an elongated member and supports therefor.

9. The method according to claim 8 wherein said supports comprise supply and take-up reels.

10. The method according to claim 9 wherein said elongated member is fabricated from perfluoroalkoxy resin.

* * * * *